United States Patent [19]

Barclay

[11] Patent Number: 4,967,324

[45] Date of Patent: Oct. 30, 1990

[54] PIVOTABLE LUMINAIRE

[75] Inventor: John A. Barclay, Johannesburg, South Africa

[73] Assignee: Lascon Lighting Industries (Proprietary) Limited, Johannesburg, South Africa

[21] Appl. No.: 211,365

[22] Filed: Jun. 24, 1988

[30] Foreign Application Priority Data

Jun. 26, 1987 [ZA] South Africa ..... 87/4620

[51] Int. Cl.[5] ..... F21S 1/02

[52] U.S. Cl. ..... 362/147; 362/269; 362/287

[58] Field of Search ..... 49/461; 29/278; 362/147, 148, 150, 220, 233, 250, 269, 287, 364, 217

[56] References Cited

U.S. PATENT DOCUMENTS

| | | | |
|---|---|---|---|
| 488,971 | 12/1891 | Oliver . | |
| 933,854 | 4/1908 | Sciple . | |
| 2,063,583 | 12/1936 | Christy | 49/461 |
| 3,530,625 | 9/1970 | Ollinger | 29/278 |
| 3,660,651 | 5/1972 | Miles, Jr. | 362/364 |
| 3,778,609 | 12/1973 | Liberman | 362/364 |
| 3,790,774 | 2/1974 | Miller et al. | 362/220 |
| 4,175,281 | 11/1979 | Lonseth | 362/148 |
| 4,222,093 | 9/1980 | Garcia et al. | 362/147 |
| 4,255,781 | 3/1981 | Plemmons et al. | 362/364 |
| 4,651,258 | 3/1987 | Davis et al. | 362/147 |
| 4,674,016 | 6/1987 | Gallagher | 362/217 |

FOREIGN PATENT DOCUMENTS

| | | | |
|---|---|---|---|
| 34204 | 6/1905 | Fed. Rep. of Germany | 49/461 |
| 729239 | 6/1946 | Fed. Rep. of Germany . | |
| 1365409 | 5/1963 | France . | |
| 886062 | 3/1960 | United Kingdom . | |

*Primary Examiner*—Ira S. Lazarus
*Assistant Examiner*—Sue Hagarman
*Attorney, Agent, or Firm*—Darby & Darby

[57] ABSTRACT

A luminaire for fitting in a ceiling has a carrier frame with a rectangular slot in it which receives a reflector unit. The reflector unit carries lamps and is pivotably mounted to swing from its operatively longitudinal position, to a dependant position in which the lamps are accessable.

16 Claims, 7 Drawing Sheets

PIVOTABLE LUMINAIRE

This invention relates to a luminaire of the type which is fitted into or on to a ceiling.

Luminaires of this kind are widely used in offices, shops and similar premises. One kind which is known to the applicant consists of a box structure made of metal sheet. The lower side of the box structure is defined by a reflector unit (also known as a louvre) or a diffuser which is located flush with the ceiling when the box structure is operatively positioned within the plenum above the ceiling. Lamps are mounted within the box structure.

A luminaire of this kind suffers from disadvantages. When the lamps, starters or ballasts have to be replaced from time to time, access has to be gained to the lamps or starters within the box structure. In order to do so, it is usually necessary to use a ladder. This is time consuming and can be inconvenient. Moreover, in open plan offices and shops it is often difficult to position ladders under the luminaires.

Another disadvantage of a prior art luminaire is that either a ceiling panel or the entire box structure must be removed from the ceiling to gain access to the ceiling plenum. Also, because the lamps and reflector unit are mounted separately on the box structure of the prior art luminaire, their alignment relative to one another is not always accurate, which can affect the performance of the luminaire. Further, because of the height of the box structure of a prior art luminaire, the ceiling plenum within which the luminaire is housed must be of relatively great depth, which can increase building costs. Accessing the box from the front also often results in fingermarks on the reflective surface which cam impede its effectivity and be unsightly.

It is an object of the invention to provide a luminaire in which one or more of the abovementioned disadvantages of prior art luminaires are sought to be overcome.

A luminaire according to the invention which is adapted to be mounted in or on a ceiling comprises carrier means mountable in or on the ceiling, a reflector unit receivable on the carrier means and adapted to receive a lamp means, the reflector unit being displaceable relative to the carrier means to give access to the lamp position.

The carrier means may be in the form of a rectangular carrier tray having an aperture therein extending centrally along the length thereof, the reflector unit occupying the aperture in the carrier tray in an operative position of the reflector unit. The lamp may be carried on a lamp holder carrier mountable on the reflector unit on the upper side thereof. The lamp holder carrier may also carry a starter for the lamp and a terminal block connector for an electrical cable supplying power to the lamp.

The reflector unit is preferably pivotted to the carrier tray so that it can be swung from its operative horizontal position to a dependant position.

In an alternative form, the carrier means may comprise two carrier parts adapted to be mounted in or on the ceiling at positions spaced from one another, the reflector unit being receivable at opposite ends thereof on the carrier parts.

The term 'reflector unit' in this specification should be understood to include a housing means for a lamp including such housing used to hold diffuser element.

Preferred embodiments of the invention are described below by way of example, and with reference to the accompanying drawings, in which.

Figure 1:
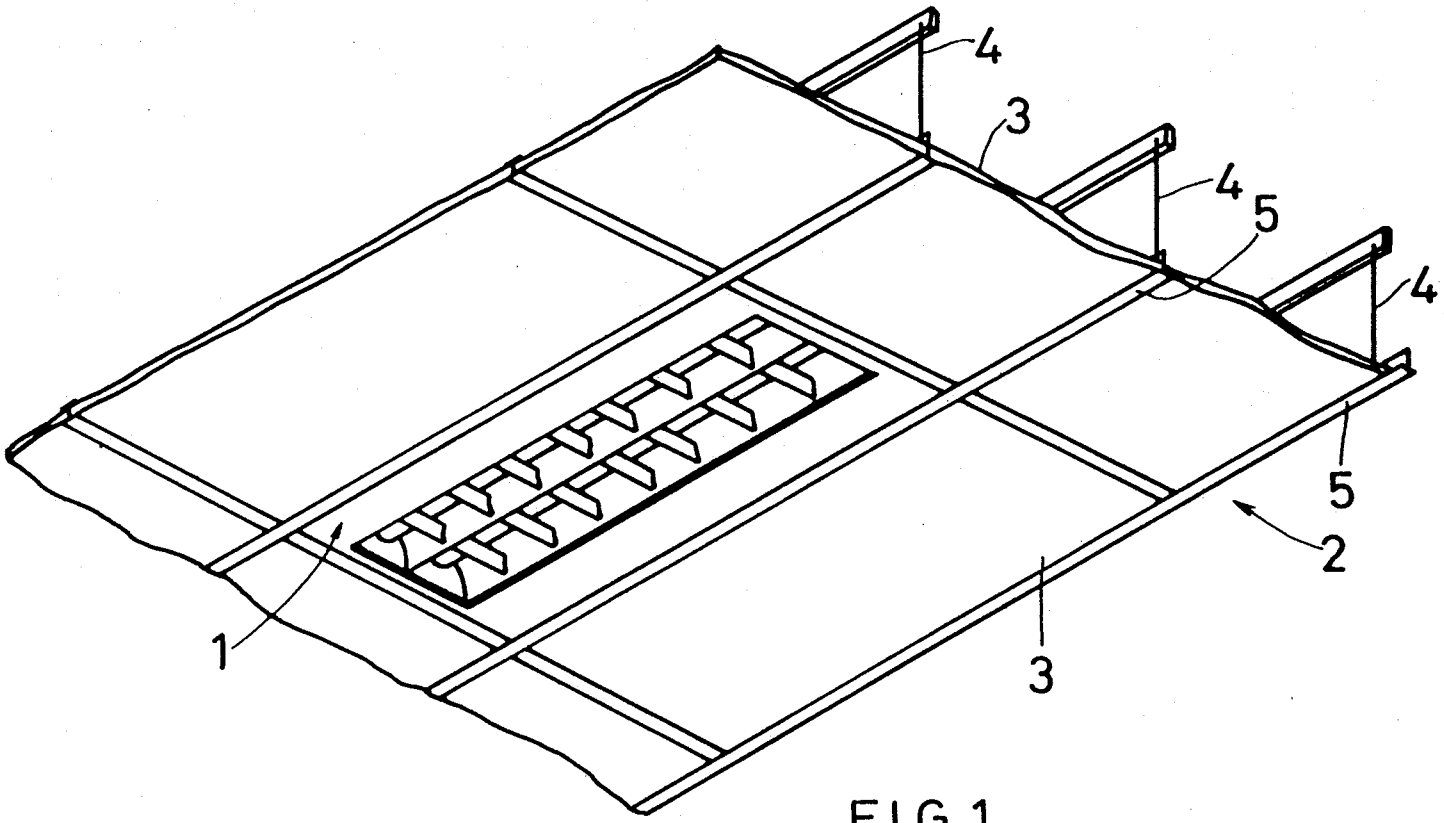
FIG. 1 is a perspective view of a luminaire according to the invention mounted in a ceiling.

With reference to FIG. 1, a luminaire (1) is mounted in a suspended ceiling (2). The ceiling (2) is of conventional construction in which ceiling panels (3) rest on a grid structure suspended by means of hangers (4) from a support surface. The grid structure is made up of elements (5) of inverted 'T' shape in cross-section, the ceiling panels (3) resting on the horizontal flanges of the elements (5). The luminaire (1) is mounted in the ceiling by being introduced into the plenum above the ceiling (2) and then being lowered to rest on the elements (5) of the grid structure, in the same manner as the ceiling panels (3).

Figure 4:
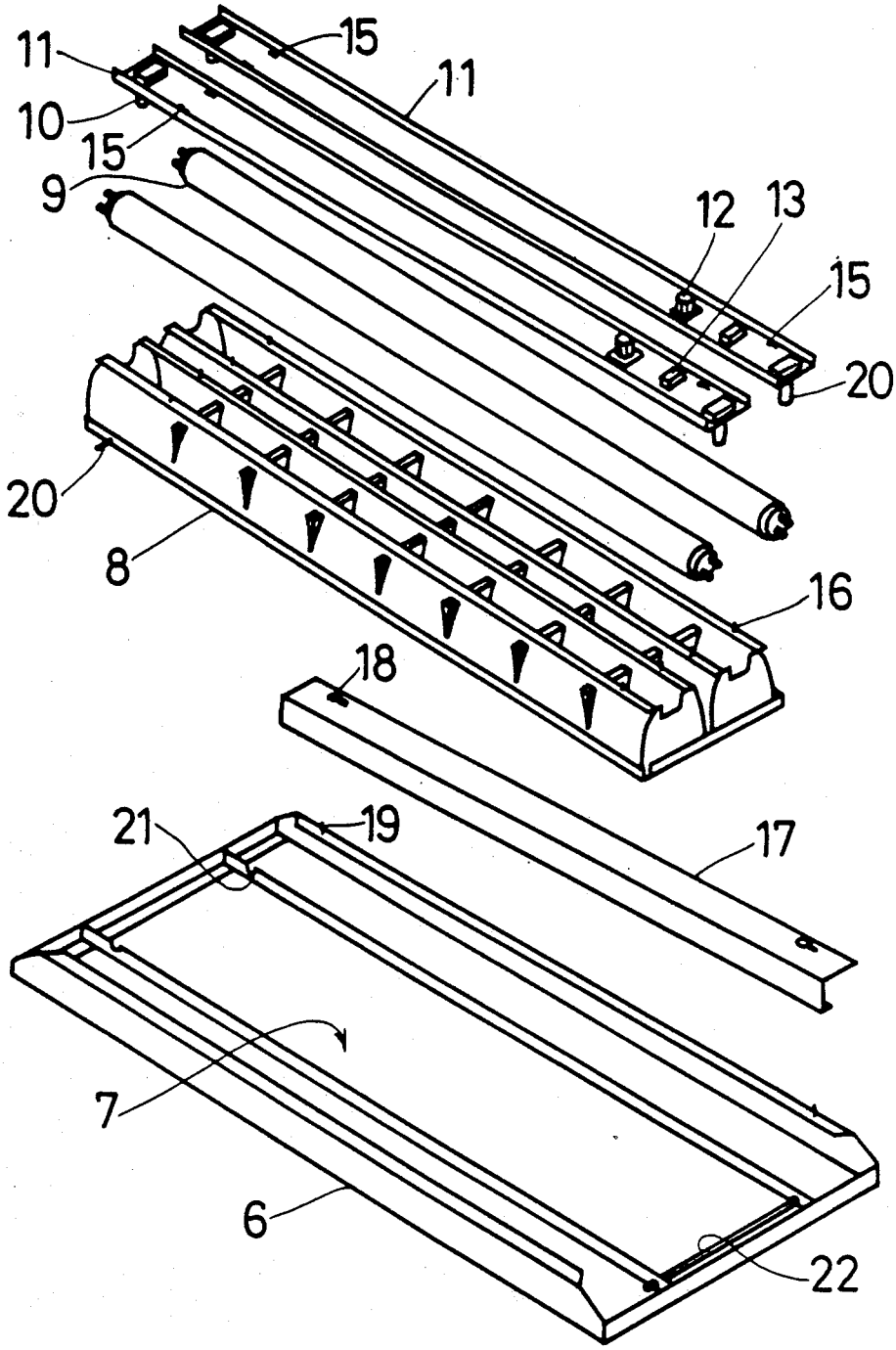
FIG. 4 is an exploded perspective view from above of the luminaire of FIGS. 1 to 3.

The components of the luminaire (1) are best illustrated in FIG. 4 in which the components are seen from above, that is, from inside the plenum above the ceiling (2). The luminaire comprises a rectangular carrier tray (6) having a central aperture (7) extending along its length. A reflector unit (8) fits on the carrier tray (6) and occupies the aperture (7). The reflector unit is positioned so that it will downwardly reflect light provided by a pair of fluorescent lamps (9).

Figure 5:
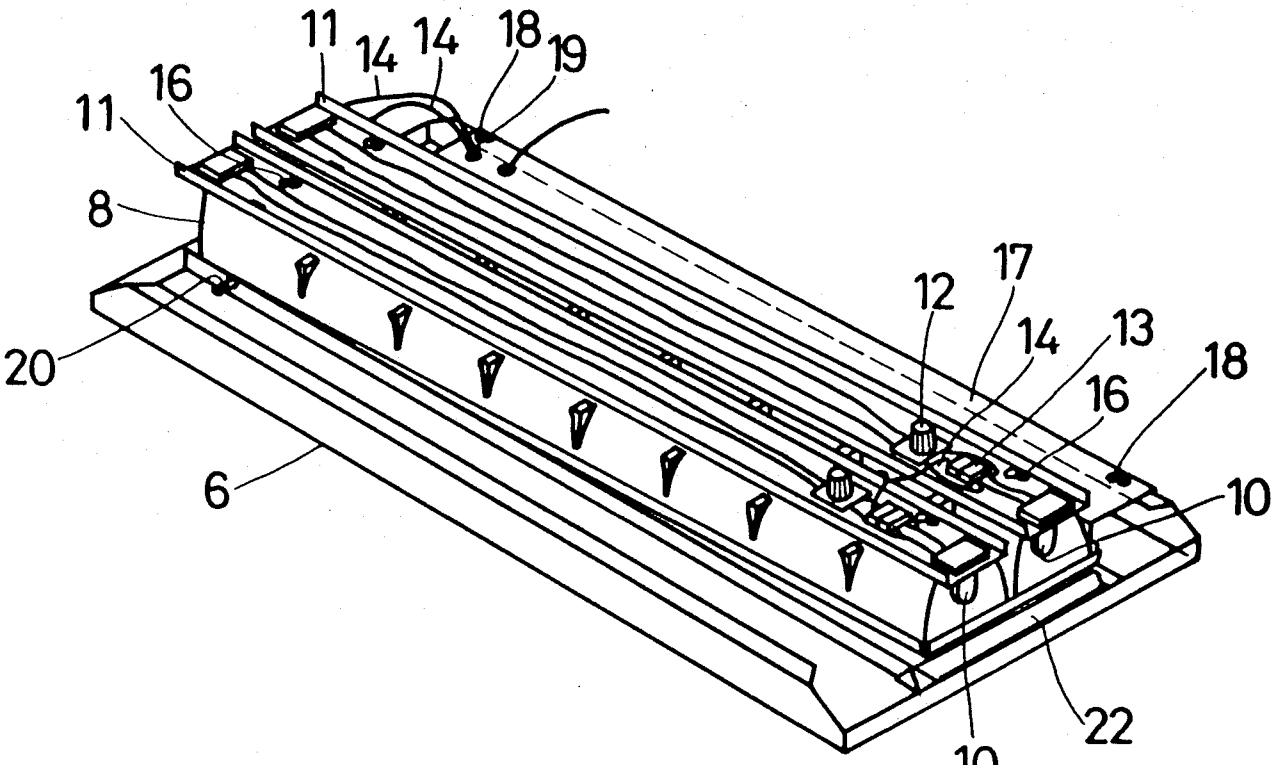
FIG. 5 is a perspective view from above of the luminaire further illustrating the luminaire.
Figure 6:
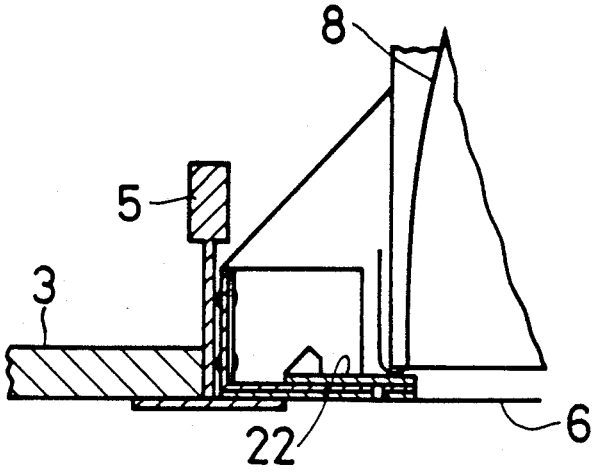
FIGS. 6 & 7 are enlarged views of parts of the luminaire.

Each lamp (9) is carried by lamp holders (10) mounted on a lamp holder carrier (11). The lamp holder carrier (11) fits directly onto the reflector unit (8). Each lamp holder carrier (11) also has a starter (12) and terminal block connector (13) mounted on it. As shown in FIG. 5, electrical cables (14) which supply power to the lamps (9), connect to the terminal block connectors (13). In this embodiment of the invention each lamp holder carrier (11) is fitted to the reflector unit (8) by inter-engagement of a series of keyhole slots (15) in the lamp holder carrier (11) with a corresponding series of lugs (16) provided on the reflector unit (8). This arrangement permits the lamp holder carriers (11) to be mounted on the reflector unit in clip-on manner. Swivel clips or alternative clip-on arrangements may be used.

A channel member (17) is mounted on the carrier tray (6) to one side of the aperture (7). The channel member (17) conveniently has a pair of keyhole slots (18) which inter-engage with a pair of screws (19) on the carrier tray (6) in clip-on manner. The channel member (17) carries the control gear (not shown) of the luminaire (1).

Figure 2:
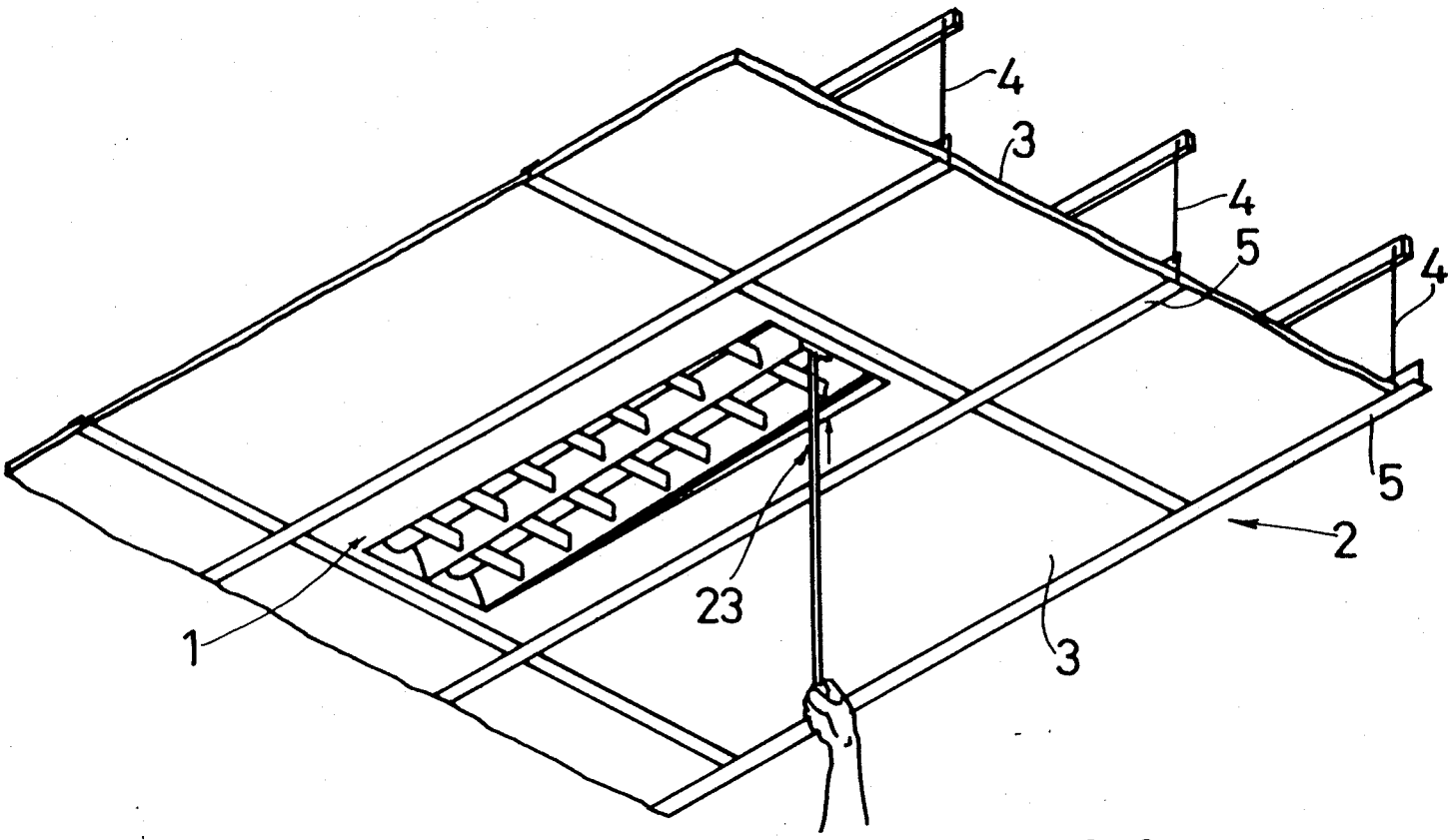
FIGS. 2 & 3 are similar views showing how a part of the luminaire is demounted.
Figure 3:
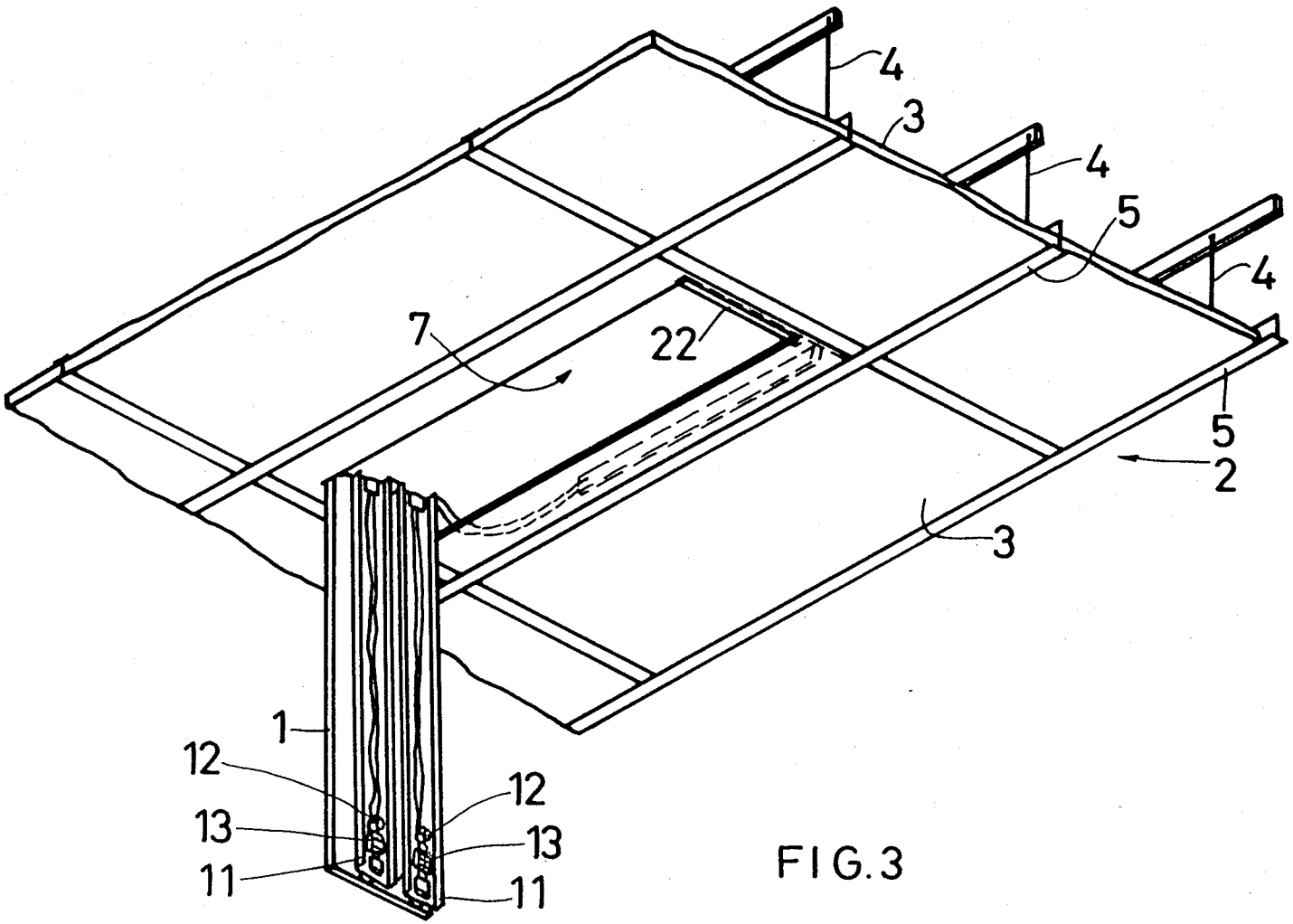

At one end the reflector unit (8) has a pair of stub pivots (20) which are received in a corresponding pair of cradle recesses (21) in the carrier tray (6). At the opposite end of the aperture (7) the carrier tray (6) has latching means in the form of a hinged flange (22). The hinged flange may be spring loaded to assume a horizontal position, or it may do so under the action of gravity. The arrangement is such that in its operative position the reflector unit (8) rests at one end in the recesses (21) of the carrier tray (6) and at the other end on the flange (22). When the end of the reflector unit resting on the hinged flange (22) is lifted together with the hinged flange (22) as indicated in FIG. 2, this end of the reflector unit can clear the aperture (7) and the reflector unit can be swung downwardly about the stub pivots (20) to the position shown in FIG. 3. In this position the lamp holder carriers (11) can readily be removed to replace the fluorescent lamps (9) and starters (12). Access is also given to the upper side of the carrier tray (6) as shown in FIG. 4 if the control gear mounted in the channel member (17) requires attention. The channel member (17) can easily be removed from the side of the carrier tray (6) by loosening the screws (19). Also, access is given through the aperuture (7) to the plenum above the ceiling (2) for work and inspection to be carried out in the plenum.

To return the reflector unit (8) to its horizontal operative position it is swung back through the aperture (7). In doing so it lifts the hinged flange (22) and when the reflector unit is then lowered to a horizontal position, the hinged flange (22) has returned to its normal position to provide support for the reflector unit.

Figure 7:
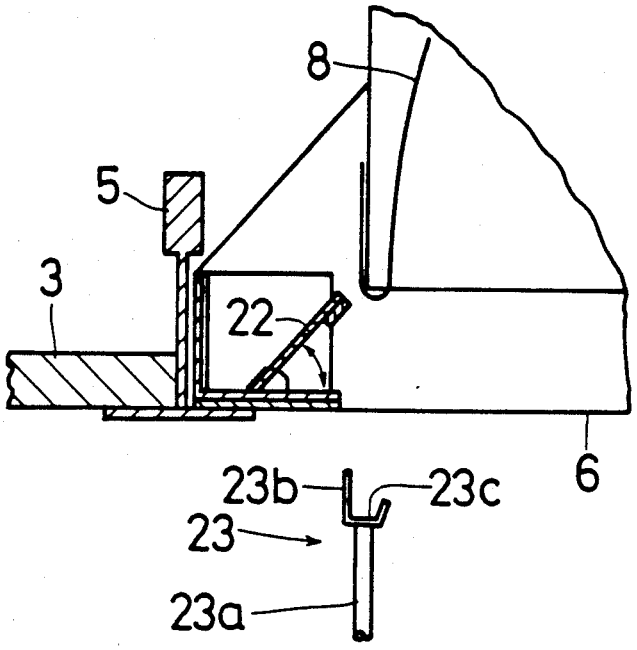

Preferably, a suitable lifting tool will be used to lower and raise the reflector unit (8). One such lifting tool (23) is shown in FIGS. 2 and 7 comprising a pole (23*a*) which has a head with flanges, (23*b*), (23*c*) arranged to engage the hinged flange (22) and reflector unit (8) respectively. An alternative tool is shown in FIGS. 1 and 8.

Figure 8:
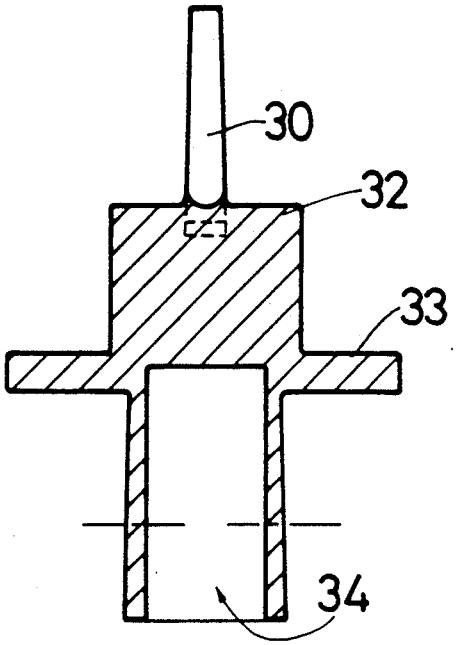
FIGS. 8 & 9 are views of an alternate opening and closing tool to that of FIGS. 2 and 7 for the luminaire.
Figure 9:
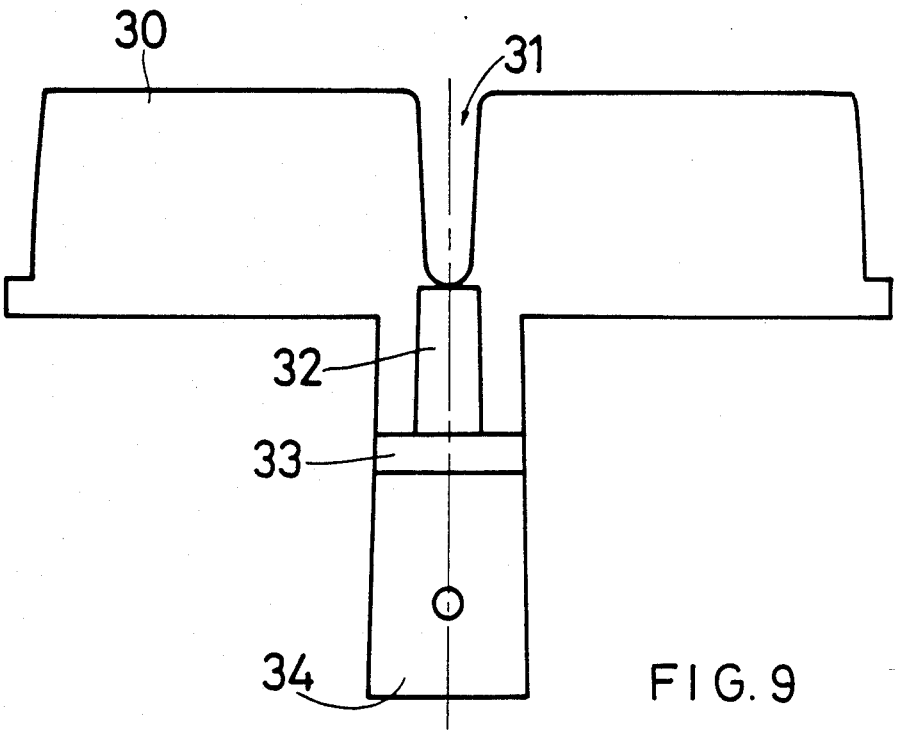

Referring to FIGS. 8 and 9, an alternative head for use in opening and closing the above described luminaire is shown. The head has an operatively vertical rectangular flange (30), with a deep 'V' slot (31) in the middle, and lateral short flanges (32) extending operatively vertically to each side of the slot. Extending passed the bottom of each lateral flange, is a further flange in the form of horizontal shelves (33) having their long edges parallel to the vertical flange. The lower end (34) of the head has an axial opening for receiving a pole end.

In use, the slot accommodates the 'V' of the reflector wall, and the lateral vertical flanges engage the reflector wall edge. The horizontal shelf operates to move the carrier flange free of the reflector during raising and lowering thereof.

It will be appreciated that because of its construction the luminaire (1) has a relatively small height and can therefore be accommodated in a ceiling having a plenum of relatively small height. Because the lamp holder carriers (11) are mounted directly on the reflector unit (8), the lamps (9) are accurately positioned relative to the reflector unit (8), which ensures maximum performance of the luminaire. Also, as described earlier, it is a relatively simple matter to replace the lamps (9) and starters (12) of the luminaire and this can easily be done without the use of a ladder.

Many other embodiments of the invention may be made differing in matters of detail only from that described above and without departing from the scope of the invention as defined in the consistory statements.

What is claimed is:

1. A luminaire adapted to be mounted to a ceiling comprising carrier means mounted to a ceiling, a reflector unit receivable on the carrier means and being adapted to mechanically and electrically connect to an elongate gas discharge lamp means, the reflector unit being displaceable relative to the carrier means to lower the reflector to a position which will give a worker access to the lamp position when the worker is standing substantially at floor level.

2. A luminaire as claimed in claim 1 in which the reflector is pivotably mounted to the carrier to be movable from an operatively approximately horizontal position to a dependant position.

3. A luminaire as claimed in claim 2 in which the carrier tray has latching means for holding the reflector unit in its operative position.

4. A luminaire as claimed in claim 3 in which the latching means includes a hinged flange on the carrier movable between an operatively horizontal holding position and an upwardly inclined release position, with the reflector being pivotable from its dependent position upwardly to engage the flange in its holding position and swing the flange to its release position, and to further move passed the flange to allow it to return to its holding position, and to pivot downwardly again to rest on the flange in that holding position

5. A luminaire as claimed in claim 4 in which the flange is biased to its holding position under force of gravity.

6. A luminaire as claimed in claim 1 in which the carrier tray has an aperture in it for receiving the reflector means in operative position.

7. A luminaire as claimed in claim 6 in which the upper surface of the reflector unit releasably supports a lamp holder means.

8. A luminaire as claimed in claim 7 in which the lamp holder means is arranged to carry a starter means for gas discharge tube lamps.

9. A luminaire as claimed in claim 7 in which the lamp holder means is supported on the reflector unit by clips.

10. A luminaire as claimed in claim 2 in which the reflector has laterally extending stub hinges operatively located in cradle recesses at each side of an aperture in the carrier which receives the reflector.

11. A tool adapted for use in raising and lowering a reflector in a luminaire as claimed in claim 4, said tool comprising a head on a pole, the head having a reflector engaging formation and a formation arranged to engage the hinged flange of the carrier and swing it upwardly to clear the reflector for movement passed the flange.

12. A tool as claimed in claim 11 in which the head has at least one shaped recess arranged to engage partitions between reflector compartments, and a lug extending laterally from the recess arranged to engage the carrier flange.

13. A luminaire as claimed in claim 2 in which the carrier tray has an aperture in it for receiving the reflector means in operative position.

14. A luminaire as claimed in claim 3 in which the carrier tray has an aperture in it for receiving the reflector means in operative position.

15. A luminaire as claimed in claim 4 in which the carrier tray has an aperture in it for receiving the reflector means in operative position.

16. A luminaire as claimed in claim 5 in which the carrier tray has an aperture in it for receiving the reflector means in operative position.

* * * * *